US005655288A

United States Patent [19]

Onishi

[11] Patent Number: 5,655,288

[45] Date of Patent: Aug. 12, 1997

[54] METHOD OF MANUFACTURING A THERMAL HEAD

[75] Inventor: Hiroaki Onishi, Kyoto, Japan

[73] Assignee: Rohm Co., Ltd., Kyoto, Japan

[21] Appl. No.: 409,653

[22] Filed: Mar. 24, 1995

[30] Foreign Application Priority Data

| | | | |
|---|---|---|---|
| Mar. 25, 1994 | [JP] | Japan | 6-056319 |
| Apr. 15, 1994 | [JP] | Japan | 6-076938 |
| Mar. 13, 1995 | [JP] | Japan | 7-052177 |

[51] Int. Cl.[6] ..... H05B 3/00

[52] U.S. Cl. ..... 29/611; 347/202

[58] Field of Search ..... 29/611; 347/202, 347/203

[56] References Cited

U.S. PATENT DOCUMENTS

| | | | |
|---|---|---|---|
| 5,317,341 | 5/1994 | Tatsumi | 29/611 |
| 5,367,320 | 11/1994 | Taniguchi et al. | 29/611 |

*Primary Examiner*—P. W. Echols

*Attorney, Agent, or Firm*—Fish & Richardson P.C.

[57] ABSTRACT

The shape of a localized glaze layer strip for a thermal head is appropriately and suitably formed. A thermoplastic insulating layer is formed on a predetermined area of a substrate, and an unnecessary portion of the insulating layer is removed so as to leave a predetermined portion forming an insulating layer strip having a uniform width. The insulating layer strip is heated at a temperature higher than the softening point thereof for chamfering the corner edges. Finally, a heating element is formed on the top of the insulating layer strip.

12 Claims, 12 Drawing Sheets

METHOD OF MANUFACTURING A THERMAL HEAD

BACKGROUND OF THE INVENTION

1. Field of the Invention

This invention relates to a thermal head, which is a printing component in a printer for thermally carrying out a printing operation onto thermosensible paper or, which utilizes thermal fusion and transfer of ink on an ink donor sheet onto a receiver, or which works as a fixing heater in a copying machine for fixing a powdered ink onto paper.

2. Description of the Related Art

A conventional thermal head Generally employs a localized glaze layer structure (hereinafter referred to as a "partial glaze" structure) for the purpose of effective thermal transmission, which is disclosed, for example, in Japan Patent Publication (SHO)63-35597. Such a conventional thermal head having a partial glaze structure is shown in FIGS. 24–27.

Referring to FIG. 24, a prior art thermal head 20 comprises an alumina substrate 21, a glass glaze strip 22 (i.e. partial glaze 22) printed on the substrate 21 by screen printing, and a heating element strip 23 formed on and along the top of the glaze strip 22. The heating element 23 is connected to driving circuits 25 via conductive patterns 24 formed on the substrate 20 by printing or vapor deposition and made of conductive material such as Gold. The heating element 23 is driven by electrical control of the driving circuits 25 so as to generate heat. The material of the glaze layer 22 is prepared by mixing and melting $SiO_2$, MgO, CaO, $Al_2O_3$, BaO, Sr (strontium), etc., then solidifying and grinding it into powder, and mixing resin and thinner into the powder to make a paste. The paste is printed on the substrate, which is then annealed to form a glaze strip.

FIGS. 25 and 26 show, in the form of a cross-section, Glaze layer strips with different widths, both showing before and after the annealing. In FIG. 25, the width of the paste strip (i.e. paste printing width) is set narrow, while in FIG. 26, the width is relatively large. Generally, when the width "W" exceeds 2.5 mm, the material paste 22' tends to swell at both ends in the width direction, i.e. along the longitudinal sides of the paste strip (see FIG. 26, the swelling portions are indicated by numeral 22A.) For this reason, the printing width of the paste is set to 2.5 mm or less, and preferably, less than 2 mm. The paste 22' printed on the substrate is then annealed at about 1,000° C. The glaze strip is convexly shaped (having a mountain like cross-section) by the inherent viscosity of the material (See the above-mentioned SHO 63-35597).

Generally, as is shown in FIG. 27, the thermal head 20 is manufactured by forming a plurality of thermal heads on an alumina substrate 26 and cutting them out separately.

The smoothly curved cross-sectional shape of the localized glaze layer 22 enables good contact between the thermal head and heated (printed) medium and efficient heat transmission. However, the glaze layer also works as a thermal storage layer, and such a thermal storage phenomenon becomes a disadvantage for high speed printing where cooling and heating operations must be repeated at high speed.

In order to overcome this problem, attempts were made to decrease the heat capacity of the glaze layer strip 22 by making the cross-section area of the glaze strip 22 smaller. However, minute printing of a glaze layer strip having a narrow width on a substrate requires a high level printing technique. Even using the most advanced printing techniques, 0.3 mm is the minimum width.

Although the width of the glaze strip is theoretically defined by the viscosity of the material paste, the actual width is influenced by subtle variations in environmental temperature during the annealing, or the annealing time itself, which results in variations in the resultant glaze layer. Due to this, it was difficult to form a glaze strip having a small and uniform cross sectional area. Especially, maintaining the minimum width of 0.3 mm during mass-production of the thermal head was difficult. Furthermore, although it is preferable to make the height of the partial glaze 22 higher for better contact with the paper, the height (i.e. thickness) of the material paste simultaneously printed on the substrate is also limited by the viscosity of the material paste, and it is very difficult to make the height higher while decreasing the width of the glaze layer strip Thus, this implies limitations in design aspect as well as in printing technique.

In view of the above mentioned limitations, it was proposed to increase the viscosity of the material paste for the purpose of making the width of the glaze layer strip smaller. However, in order to increase the viscosity, impurities added into the material paste are naturally increased. Even if the printing condition of a material paste having high viscosity is good, the impurities, such as binder, are evaporated during the annealing of the printed material paste (in the furnace at 1,000° C.), which results in a uneven surface of the glaze strip 22. The unevenness of the surface of the partial glaze 22 will cause many problems in later processes, for example, a heating element formed on the glaze layer 22 after printing and annealing of a resistance paste is inferior, and the contacting condition between the thermal head and paper is impaired, causing unclear printing. Since such an uneven surface of the glaze layer can be smoothed to some extent by reannealing it at a first annealing temperature, the increase of the impurities may be fairly effective for forming a higher glaze layer strip. However, the amount of the binder added is limited, and it must not exceed the amount of glass component, and it is difficult to make a suitable material paste which can realize a preferable height and width of the glaze layer 22.

The inventor found that as the curvature of the convex surface of the glaze layer becomes large, the contact condition between the thermal head and thermosensible paper becomes better. However, since the curvature of the glaze layer strip is defined by the viscosity and the width of the material paste, it is still difficult to realize a glaze layer strip which satisfies both requirements of larger curvature and smaller heat storage.

SUMMARY OF THE INVENTION

In view of the above-mentioned problems, it is an object of the invention to provide a method of manufacturing a thermal head having an effective glaze strip structure with an appropriate curvature for printing pressure and a thermal storage suitable to a high speed printing operation.

In order to achieve the object, the manufacturing method comprises the steps of forming a thermoplastic insulating layer on a predetermined area of a substrate, removing an unnecessary portion of the insulating layer so as to leave a predetermined portion forming an insulating layer strip having a substantially uniform width, heating the insulating layer strip at a temperature higher than the softening point thereof, and forming a heating element on the insulating layer strip.

In another aspect of the invention, the manufacturing method of a thermal head comprises the steps of forming a thermoplastic insulating layer having a rectangular plan view on a predetermined area of a substrate, forming a groove on the rectangular insulating layer along and parallel to one side thereof, at a predetermined distance from the side, so as to divide the rectangular insulating layer into an insulating layer strip having a predetermined width and a remaining insulating layer region, heating the insulating layer strip and the other insulating layer region at a temperature higher than the softening point thereof, forming a heating element on the insulating layer strip, and mounting driving circuit elements on the other insulating layer region.

The substrate may be made of ceramic material, and the insulating layer contains glass as a main component. The groove may be formed so as not to reach the surface of the substrate. The method may include the step of forming interconnect patterns on the surface of the groove for providing electrical connection between the heating element and the driving circuit elements.

In still another aspect of the invention, a method for manufacturing a thermal head comprises the steps of forming a thermoplastic insulating layer over the whole surface of a rectangular substrate, forming a pair of grooves spaced apart from each other by a predetermined distance to form an insulating layer strip therebetween, heating the insulating layer at a temperature higher than the softening point thereof, and forming a heating element on the insulating layer strip of predetermined width.

A value of the height divided by the width (H/W) of the insulating layer strip is set to 0.1 or more.

The forming of the insulating layer strip is carried out by cutting and removing an unnecessary portion.

The cutting and removing operation is carried out by rotation of a disc blade. At least one side of the insulating layer strip may be formed as a slope, using a disc blade having a tapered cutting surface.

The manufacturing method may include the steps of forming an elastic protecting layer on a predetermined portion of the insulating layer, and removing a remaining portion which is not covered with the protecting layer, to form an insulating layer strip. The protecting layer may be a resist film made of a photosensitive polymer.

The removal of the insulating layer portion which is not covered with the protecting layer is carried out by projecting abrasive particles from above toward the substrate so as to hit the insulating layer portion at high speed and remove it. The removal may also be carried out by chemical wet etching. Alternatively, the removal may be carried out by plasma etching.

In still another aspect of the invention, a thermal head is provided which has a convexly projecting glaze strip with a uniform width. One side of the Glaze strip is formed as a gentle slope, which is to be a leading edge in the scanning direction, and the other side is a sharp slope, which is to be a trailing edge.

According to the manufacturing method in accordance with the invention, thermoplastic material is used as an insulating layer, and an unnecessary portion of the thermoplastic insulating layer is removed so as to leave an insulator strip (i.e. glaze strip), which is then heated at a temperature higher than the softening point, thereby achieving a desired cross-sectional shape of the glaze strip.

Furthermore, the insulating layer strip having smooth slopes, on which a heating element is provided, and the other insulating portion, on which driving circuit elements are mounted, are simultaneously formed by simply forming a groove on the rectangular thermoplastic insulating layer and heating it at a temperature higher than the softening point.

In the case of using ceramic material and glass-main material, as a substrate and an insulating layer, respectively, the groove is formed so as not to reach the surface of the substrate, and interconnect patterns are formed across the groove for electrical connection between the heating element and the driving circuit elements. In this structure, the interconnect patterns are densely formed on the smooth surface of the insulating layer containing glass as a main component. Generally, it is very difficult to form minute interconnect patterns with a fine pitch on a rough surface, such as the surface of a ceramic substrate.

By setting the value of the height of the insulating layer strip divided by the width to 0.1 or more, the area contacting with a printed object becomes smaller while the printing pressure becomes large, and in addition, heat storage in the insulating layer strip is decreased. Thus, a thermal head suitable for a high speed printing operation is realized.

The forming of the insulating layer strip is easily carried out by various techniques, for example, cutting with a disc blade, wet etching (i.e. chemical removal of an unnecessary portion after forming a protection layer on a portion to be left as an insulating layer strip), plasma etching, or physical removal by bombardment with grinding particles.

When using a disc blade for the cutting and removal, an insulating layer strip having a desired cross-sectional shape can be achieved by selecting and changing a blade shape. For example, when using a blade having a tapered cutting surface for the cutting of one side of the insulating layer belt, the resultant insulating layer strip has a slope on one side. Such a slope structure reduces a sliding resistance between the glaze strip and a heated medium (e.g. thermosensible paper).

Using a resist film made of photosensitive polymer as a protection layer allows minute and fine patterning, and therefore, the width of the insulating layer strip is relatively freely set. If using chemical wet etching, which is isotropic etching, a gently curved slope can be formed for the insulating layer strip, which can also prevent a sliding resistance, producing the same effect as using the disc blade having a tapered cutting surface.

Plasma etching, which is anisotropic etching, allows precise etching, and the width of the resultant insulating layer strip is constant and uniform.

When forming a glaze layer so that one side which is to be a leading edge in the scanning direction is a gentle slope and the other side which is to be a trailing edge is a sharp slope, an ink sheet and receiver sheet are easily separated immediately after completing the transfer of the ink onto the receiver sheet, because of the sharp slope. By tilting the substrate of the thermal head, printing pressure is increased and printing efficiency is improved, and in addition, sliding contact between the receiver sheet and the parts mounted on the substrate is avoided. Also, the substrate can be small.

DESCRIPTION OF THE PREFERRED EMBODIMENT

Figure 1:
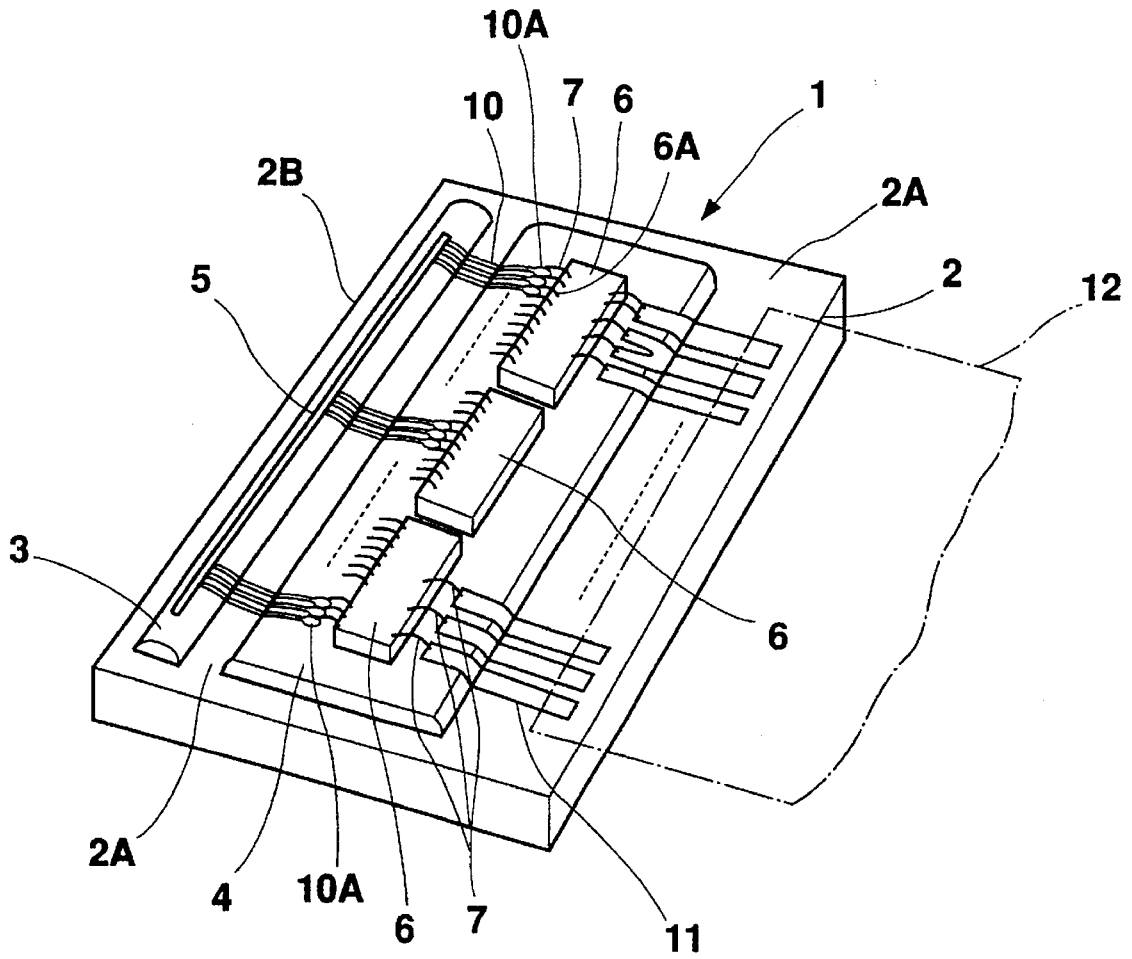
FIG. 1 is a perspective view of a thermal head in accordance with the present invention.

FIG. 1 shows a perspective view of thermal head 1 in accordance with the invention, which comprises a rectangular substrate 2 made of ceramic, a thermoplastic insulating layer strip 3 formed on the substrate surface 2A along and near one longitudinal side thereof, an insulating layer region 4 formed on the substrate surface 2A in parallel to the insulating layer strip 2 with a width greater than the width of the insulating layer strip 3, on which driving circuit elements 6 are provided, and a heating element 5 formed on the insulating layer strip 3.

The numeral 10 is assigned to interconnect patterns for electrically connecting the heating element 5 and the driving circuit element 6. The interconnect patterns 10 are formed by printing and annealing organic solder or inorganic gold paste, or a mixture of these two. Alternatively, they may be formed by vapor deposition of Al.

Second interconnect patterns 11 are arranged between the driving circuit elements 6 and flexible cable 12 which directs externally supplied control signals for the heating element 5, for electrical connection therebetween.

In this embodiment, two regions, that is, the insulating layer strip 3, on which the heating element 5 is formed, and the insulating layer region 4 for mounting the driving circuit elements 6, are simultaneously formed on the surface 2A of the substrate 2. However, forming only an insulating layer strip 3 is also effective for the thermal head. In this case, if the substrate 2 is made of a material having a rough surface, such as ceramic, the substrate surface 2A should be processed prior to the forming of the insulating layer strip 3 by covering the whole surface 2A with glass paste and annealing it. When the driving circuit elements 6 are directly formed on the uneven surface of the substrate 2, and when the pads 6A of the driving circuit elements 6 are connected via wires 7 to the bonding pads of the interconnect patterns 10 which are also formed directly on the substrate surface 2A, electrical connectivity of the wires 7 to the pads 6A is inferior (See Japan Patent Publication 63-19358). Of course, when employing a material having a superior smoothness for the substrate 2, it is not necessary to treat the surface 2A of the substrate 2.

The material of the insulating layer strip 3 and the insulating layer region 4 is glass paste which is applied on the substrate 2 and annealed. The glass paste is prepared by mixing and melting $SiO_2$, MgO, CaO, $Al_2O_3$, BaO, Sr (strontium), etc., then solidifying and grinding it into powder, and mixing resin and solvent (e.g. thinner) into the powder to make a paste. The material for the insulating layer is not limited to glass paste, but any thermoplastic material, for example, thermally stable resins such as styrene resin, acrylic resin, cellulosic resin, polyethylene resin, vinyl resin, nylon resin, carbon fluoride resin, can be used. However, in the case that the insulating layer is heated to a high temperature during later processes, e.g. in the process of forming a heating element 5 on the insulating layer strip (i.e. glaze strip) by printing and annealing at high temperature, that heating temperature must be lower than the softening point of the material of the insulating layer. For this reason, a mainly glass material is used in this embodiment because of the relatively high softening point (about 800° C.).

Figure 3:
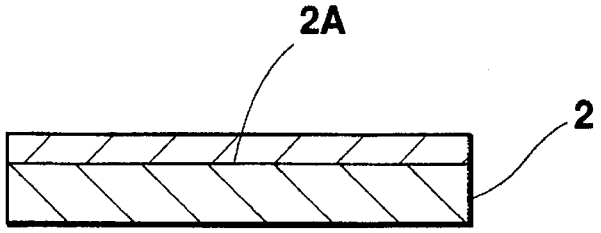
FIGS. 3, 4, 5 and 6 show the processes of manufacturing a thermal head by using a disc blade in accordance with a first embodiment of the invention.
Figure 4:
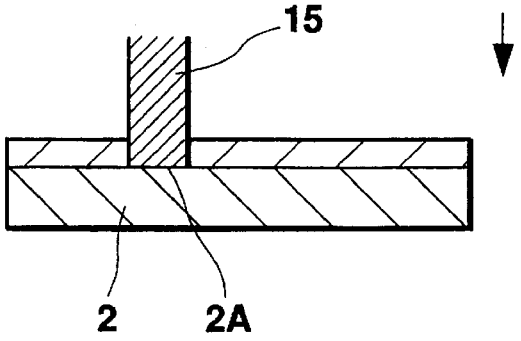
Figure 5:
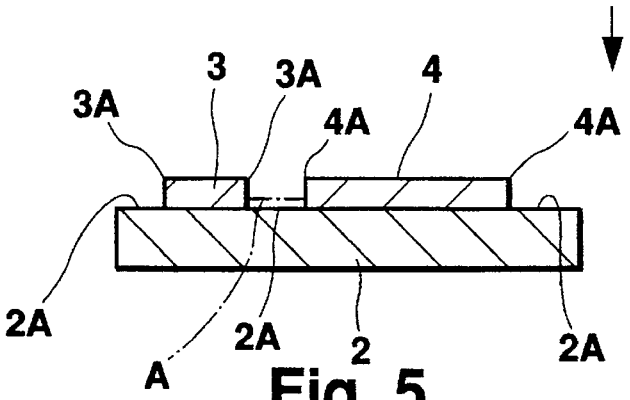
Figure 6:
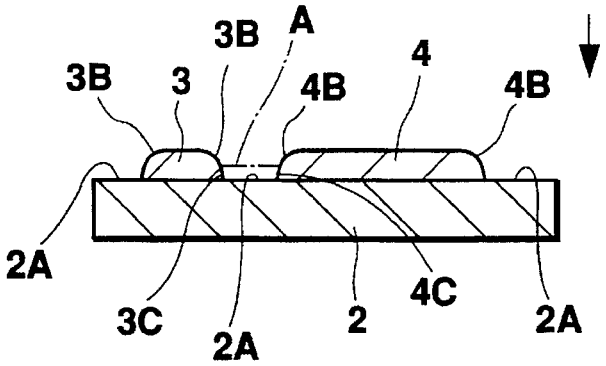
Figure 7:
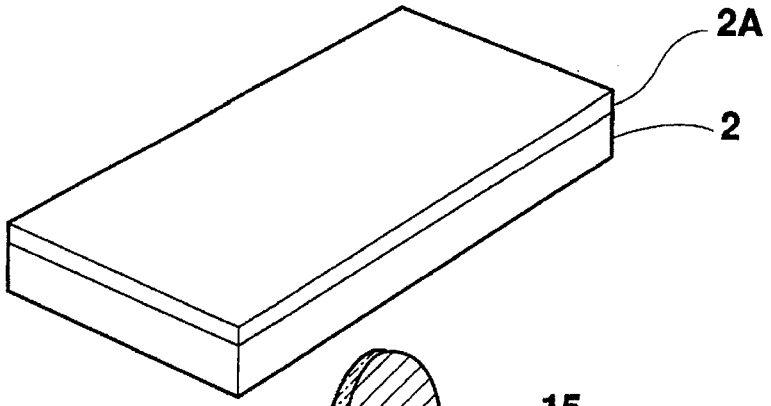
FIGS. 7, 8, 9 and 10 show the processes of manufacturing a thermal head in accordance with a modification of the first method of the invention.
Figure 8:
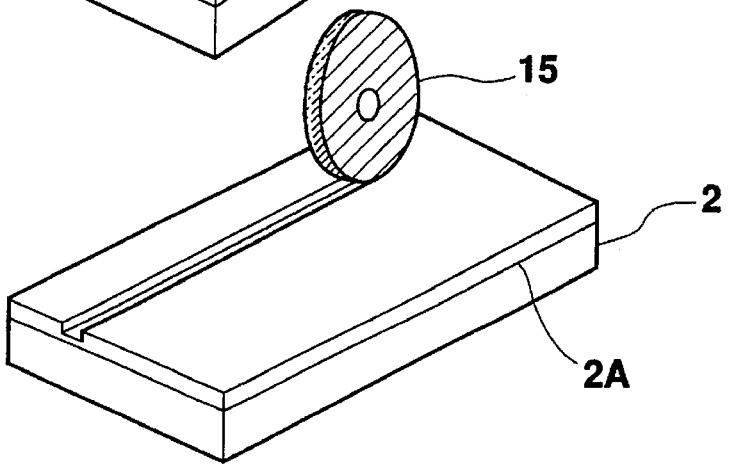
Figure 9:
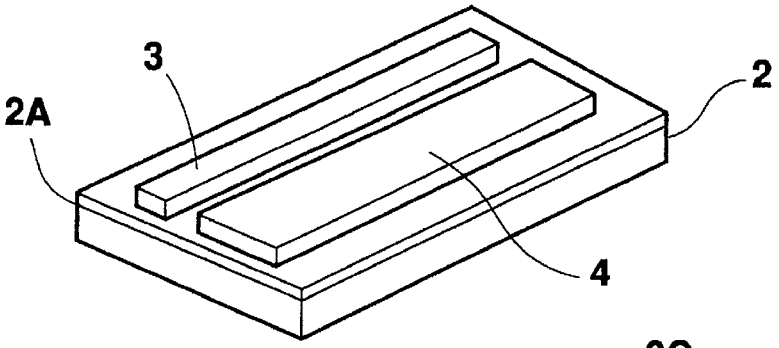

A first manufacturing method of the thermal head will now be described with reference to FIGS. 3–6. An insulating layer is formed on the whole surface 2A of the substrate 2, as is shown in FIG. 3, by applying glass paste using a screen printing technique and by annealing it at a temperature higher than 1,000° C. Then, an unnecessary portion of the insulating layer is removed by rotation of a disc type cutting blade 15 so as to leave an insulating layer strip (i.e. glaze strip) 3 and the remaining insulating layer region 4 (FIGS. 4 and 5). The thus formed insulating portions are heated at a temperature higher than the softening point (about 800° C.) and lower than the annealing temperature to melt the corner edges 3A and 4A of the insulating layer portions 3 and 4. The corner edges 3A and 4A are chamfered by surface tension, and smoothly curved corners 3B and 4B are finally formed for the insulating layer strip 3 and the insulating layer region 4, respectively, as is shown in FIG. 6.

By raising the heating temperature, the curvature of the corners 3B and 4B of the insulating layer strip 3 and the insulating layer region 4 can be increased. Larger curvature achieves better contact efficiency and realizes a good contacting condition between the thermal head and a receiver sheet (such as thermosensible paper) during the printing operation.

Figure 2:
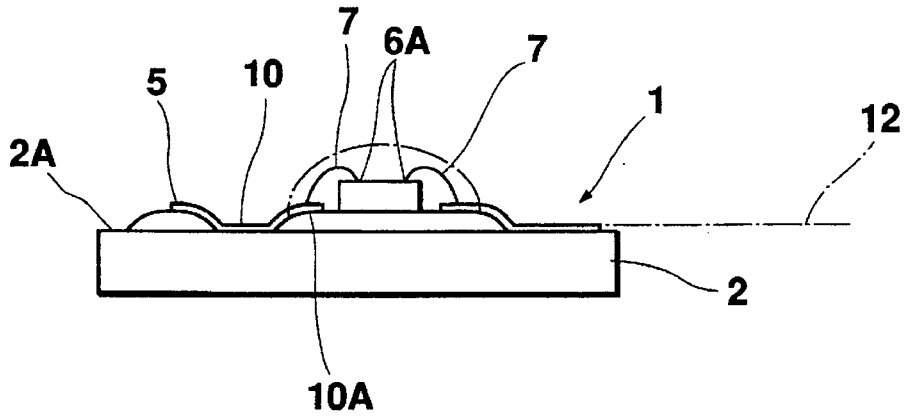
FIG. 2 is a side view of the thermal head of FIG. 1.

Although, in the embodiment, the unnecessary insulating layer portion is removed until reaching the surface 2A of the substrate 2, the cutting depth may be set so as not to reach the substrate surface 2A (referred to as half dicing) between the insulating layer strip 3 and the insulating layer region 4 (a dashed line A in FIG. 5). By setting the cutting depth halfway, the interconnect patterns 10 (See FIGS. 1 and 2)

can be formed more densely between the insulating layer strip 3 and the other insulating layer region because of the smoother surface. Also, breaking of the wires (interconnect) at the bottom skirts 3C and 4C of the insulating layer portions 3 and 4 is avoided.

In the example shown in FIGS. 7–10, the cutting depth is set to half the thickness of the insulating layer not only for the area between the insulating layer strip 3 and the insulating layer region 4, but also for all other areas surrounding the insulating layer strip 3 and the region 4. In this structure, the interconnect patterns 10 are densely formed as required without breaking of the wires at the bottom skirts 3C and 4C of the groove between the insulating layer strip 3 and the region 4.

Figure 10:
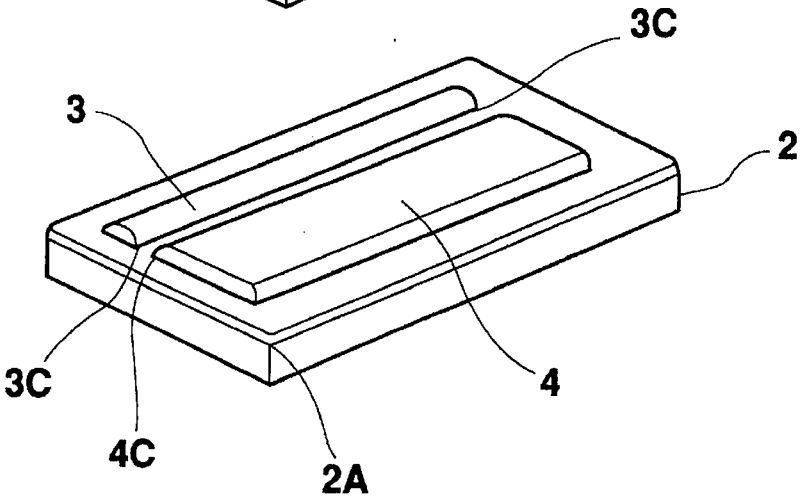
Figure 11:
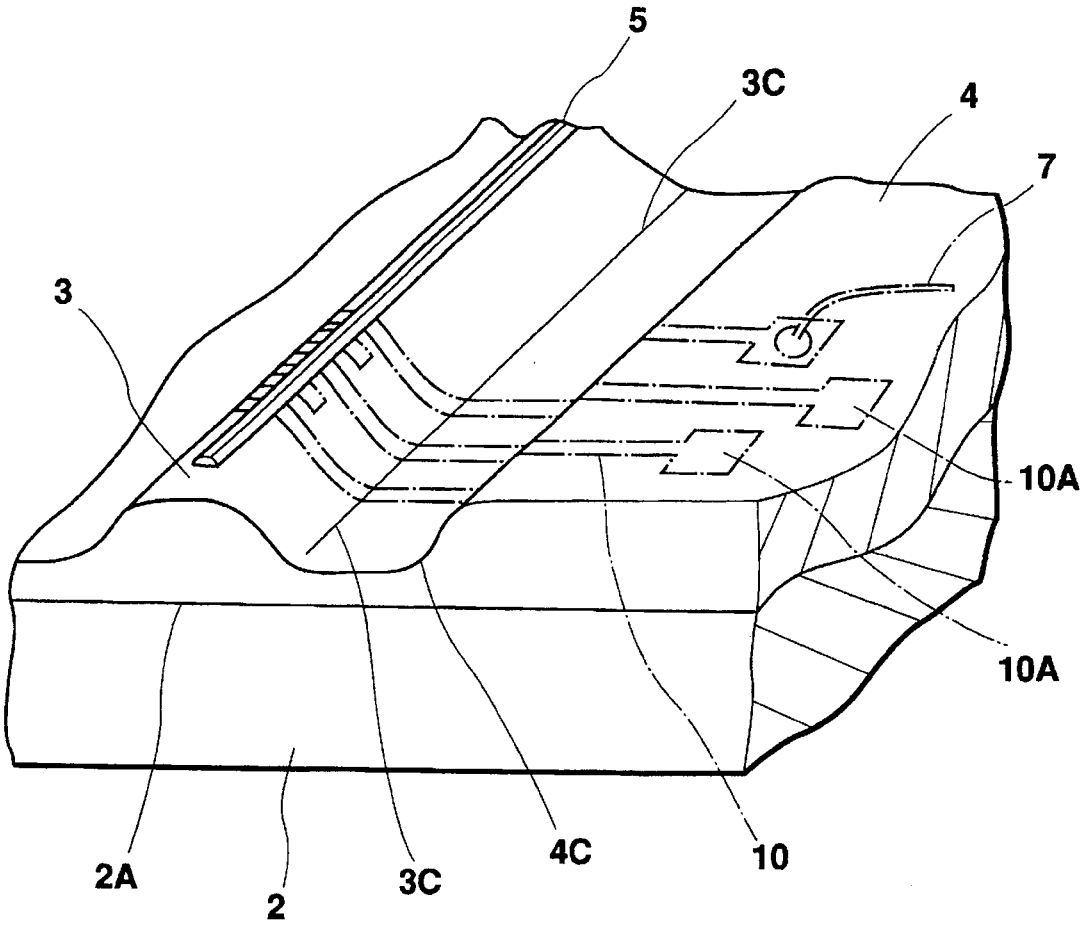
FIG. 11 is an enlarged perspective view of the thermal head shown in FIG. 10.

FIG. 11 is an enlarged perspective view showing a heating element 5 and interconnect patterns 10 formed on the insulating layer of FIG. 10. The wire 7 is made of gold and is for connecting the bonding pad 10A of the interconnect pattern 10 to a pad 6A (See FIG. 1) of the driving circuit element 6.

Figure 12:
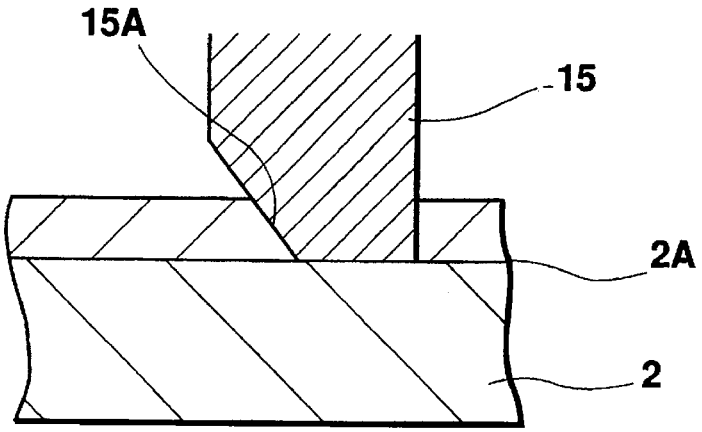
FIGS. 12, 13, 14 and 15 show the processes of forming a modified shape of the glaze layer strip in accordance with the first method of the invention.
Figure 13:
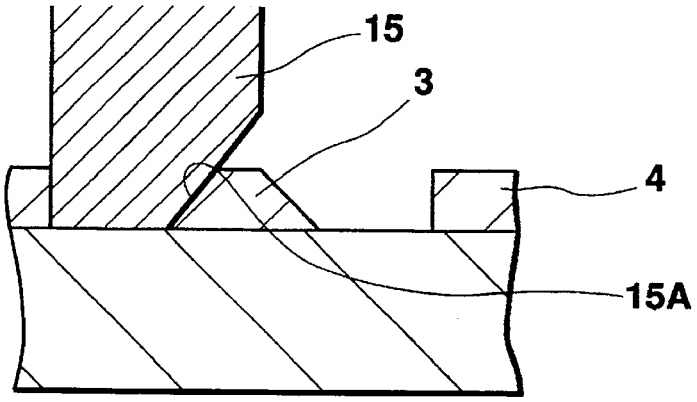
Figure 14:
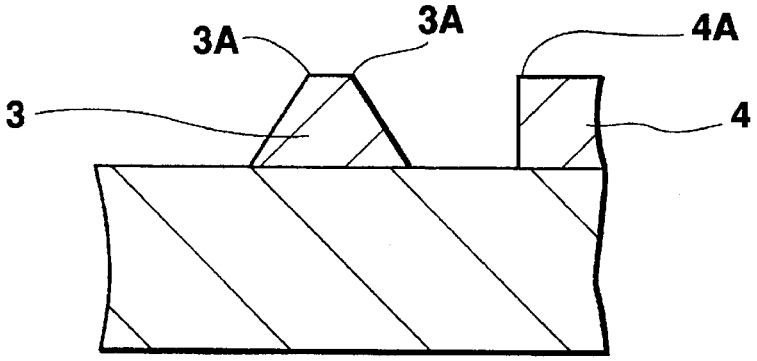
Figure 15:
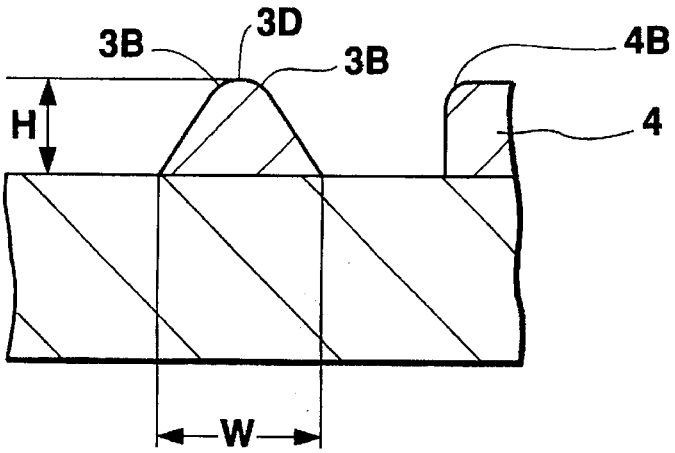

In these examples, a disc blade 15 having a straight cutting surfaces 15B (see FIG. 16) perpendicular to the insulating layer is used for the cutting. However, as shown in FIGS. 12 and 13, a modified disc blade 15 having a tapered portion 15A can be used for the cutting of both sides of the insulating layer strip 3. When using such a tapered disc blade, the resultant insulating layer strip 3 has a trapezoid cross-section, as shown in FIG. 14. By annealing the thus formed insulating layer strip 3 at a temperature higher than the softening point (e.g. at about 800° C.), the edged corners 3A are chamfered to be curved corners 3B (FIG. 15) and a mountain-like insulating layer strip having steep slopes is formed. Then, forming a heating element 5 on the top of the insulating layer strip 3 completes a superior glaze strip which can provide an efficient contacting pressure against a thermosensible paper and is suitable for a high speed printing operation with a small cross-sectional area and reduced heat storage.

Figure 16:
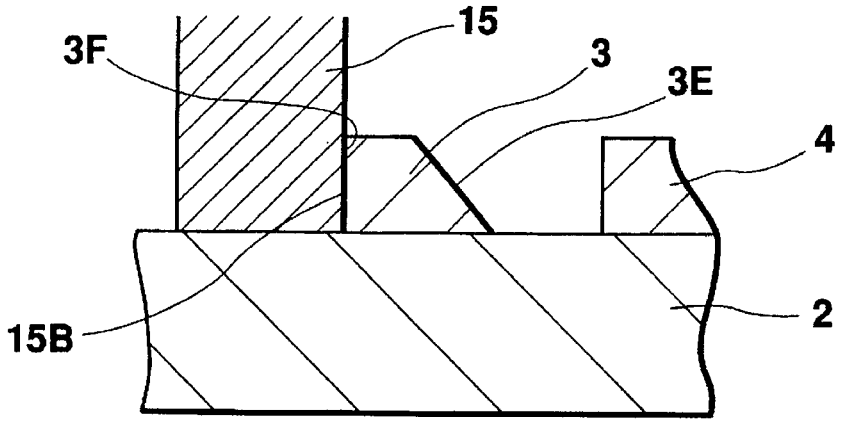
FIGS. 16, 17 and 18 show the processes of forming a further modified shape of the glaze layer strip in accordance with the first method.
Figure 17:
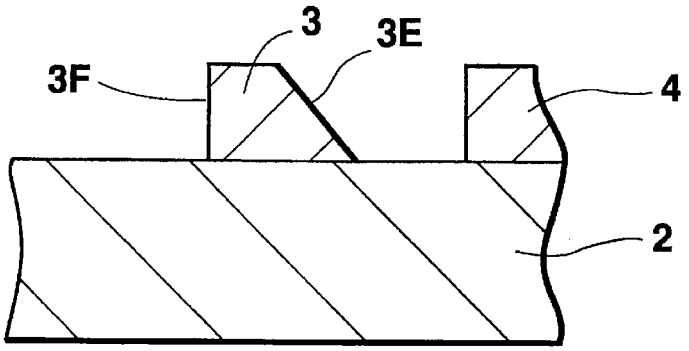
Figure 18:
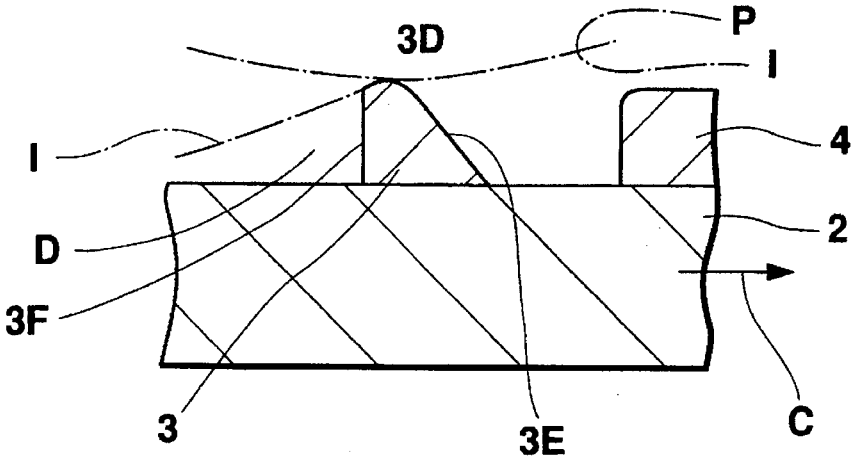

When the cutting and removal is carried out by the combination of the disc blade having a straight cutting surface and the disc blade having a tapered surface (FIGS. 16 and 17), a cross-sectional shape of the resultant insulating layer strip 3 after the annealing is a right angled triangle, having a slope 3E and a perpendicular surface 3F (FIG. 18). These processes are shown in FIGS. 16–18. In such a structure of the glaze strip 3, the ink ribbon I and the receiver sheet P are quickly separated from each other immediately after the printing operation because there is sufficient space on the perpendicular trailing side of the glaze 3.

Generally, as the thermal head 1 is moved in the direction C (i.e. the scanning direction of the thermal head 1), ink on the ink ribbon I is thermally transferred onto a sheet P by heat generated from the heating element 5. It is preferable that the ink ribbon I and the receiver sheet P are separated immediately after the thermal transfer of the ink to avoid the situation where the fused and transferred ink on the receiver sheet returns to the ink ribbon. However, in the conventional glaze strip having gentle slopes 3E on both sides of the heating element 5, the separation angle between the ink ribbon and the receiver sheet is limited to the sloped angle, and quick separation of the ink ribbon and the receiver sheet can not be achieved due to the lack of sufficient separation space. Meanwhile, the slope 3E on the leading side of the glaze strip 3 must be gentle for assuring a proper containing condition. In order to satisfy both requirements, the glaze strip 3 of the invention has a gentle slope 3E on its leading side for good contact with the sheet and a substantially perpendicular surface 3F on its trailing side for quick separation of the ink ribbon I and the receiver sheet P.

Figure 28:
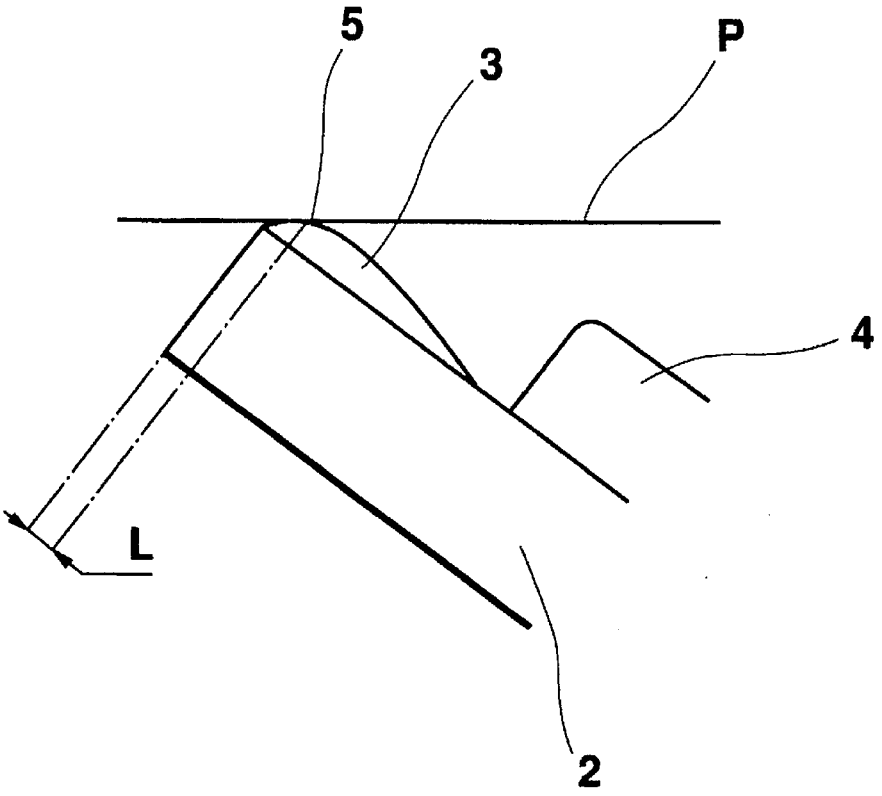
FIG. 28 shows a thermal head of the present invention in an actual use.
Figure 29:
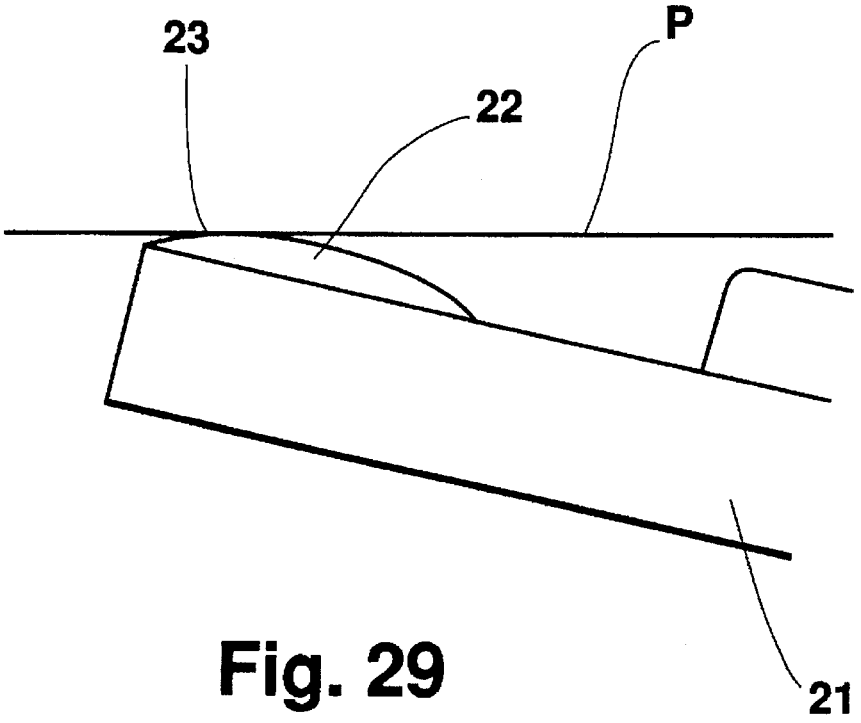
FIG. 29 shows a conventional thermal head in an actual use.

Referring to FIG. 28, the distance L between the center of the heating element 5 formed on the top of the glaze strip 3 and the trailing edge of the thermal head 1 is set small in order to increase the tilting angle of the thermal head 1. The larger tilting angle of the thermal head 1 increases the printing pressure and improves printing efficiency. In the conventional glaze strip having gentle slope on both sides of the heating element 5, the distance between the heating element 5 and the trailing edge of the thermal head 1 is relatively large, which limits the tilting angle of the thermal head, as is shown in FIG. 29.

Thus, in the first embodiment, an insulating layer strip having a desired cross-sectional shape can be formed by selecting a shape of the cutting surface of the disc blade 15.

Figure 19:
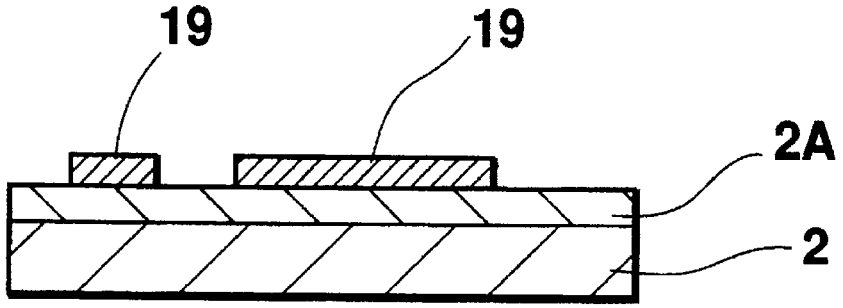
FIGS. 19, 20 and 21 show the processes of manufacturing a thermal head in accordance with a second embodiment of the invention.
Figure 20:
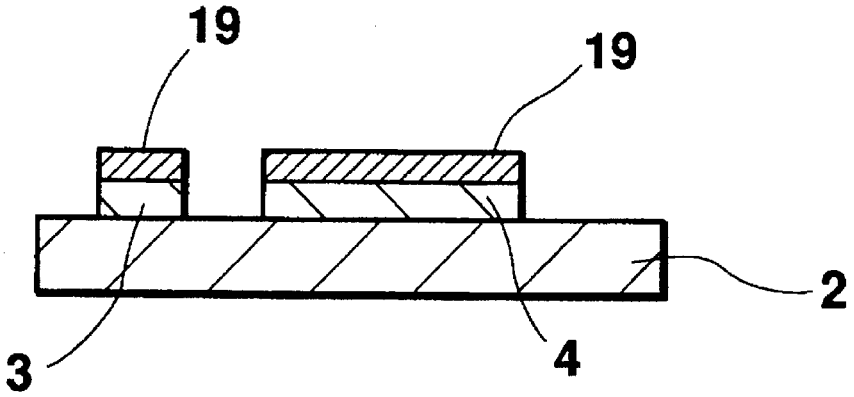
Figure 21:
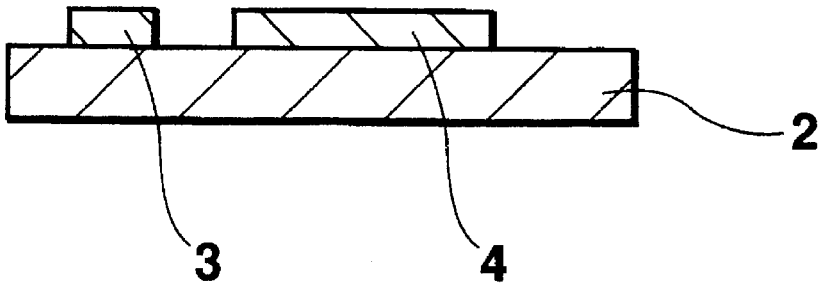

A second embodiment of the invention will now be described with reference to FIGS. 19–21. Similar to the first embodiment, an insulating layer is formed over the entire surface 2A of the substrate 2 by printing and annealing glass paste. Then, a resist film 19 made of, for example, photosensitive polymer, is formed on the portion to be left (FIG. 19). The remaining insulating layer portion which is not covered with the resist film 19 is removed by chemical wet etching, physical plasma etching, or bombardment of abrasive particles from above (FIG. 20). Finally, the resist film 19 is removed (FIG. 21).

Chemical wet etching isotropically etches the insulating layer, and a gently curved slope is created, which facilitates the corner processing by the next annealing.

Dry etching (plasma etching) is anisotropic etching, and allows precise processing. The width of the glaze strip 3 can be easily and accurately made small with a reduced heat capacity.

Equipment cost for the bombardment processing using abrasive particles is lower than that for chemical wet etching.

Figure 22:
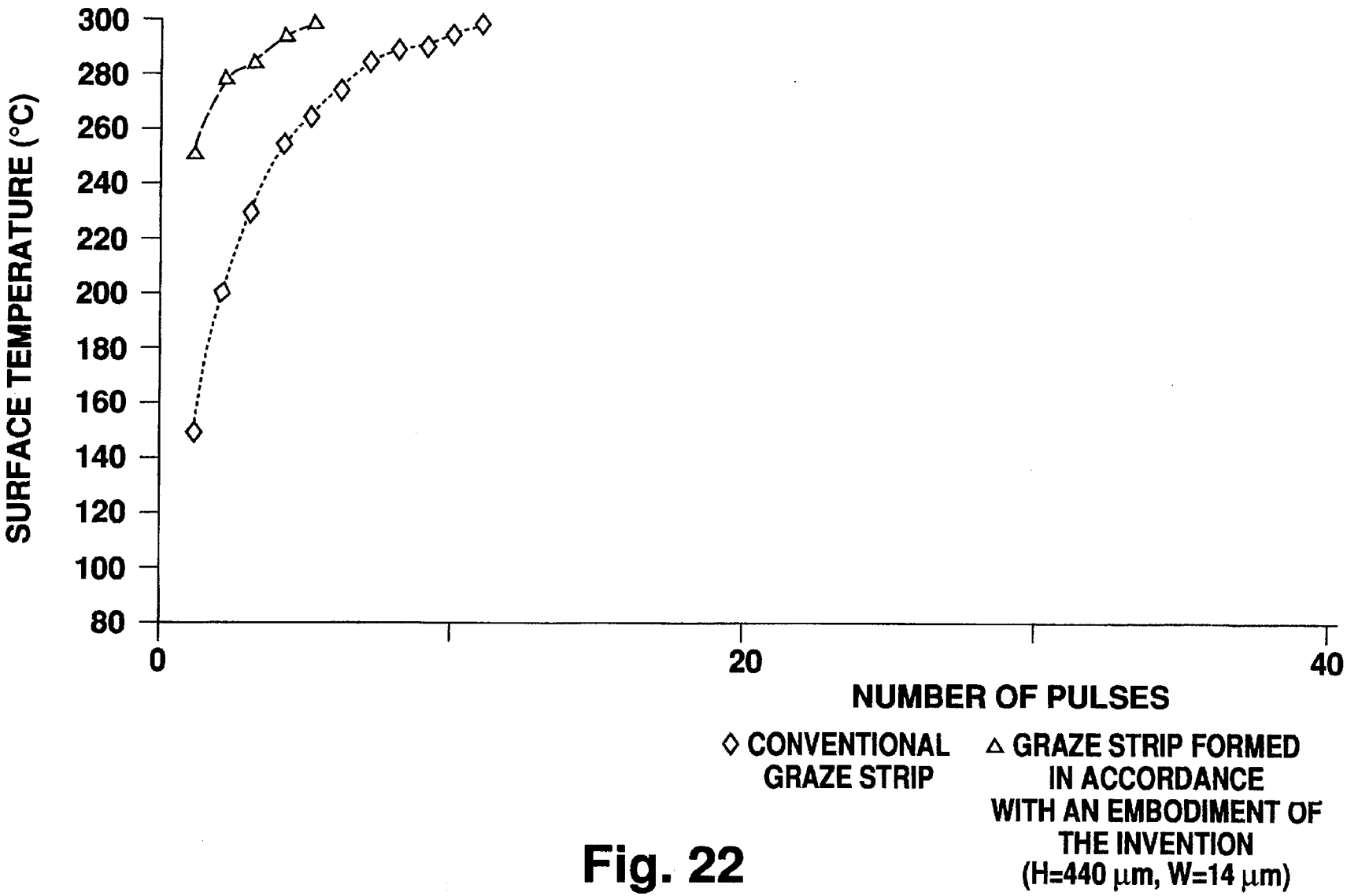
FIG. 22 is a chart showing the relationship between the surface temperature of the glaze layer and the number of pulses, comparing a glaze strip having a height "H" 440 μm and width "W" 14 μm formed by the present invention, which is represented by triangle marks, with a conventional glaze strip having a height "H" 1,040 μm and width "W" 57 μm which is represented by diamond marks.
Figure 23:
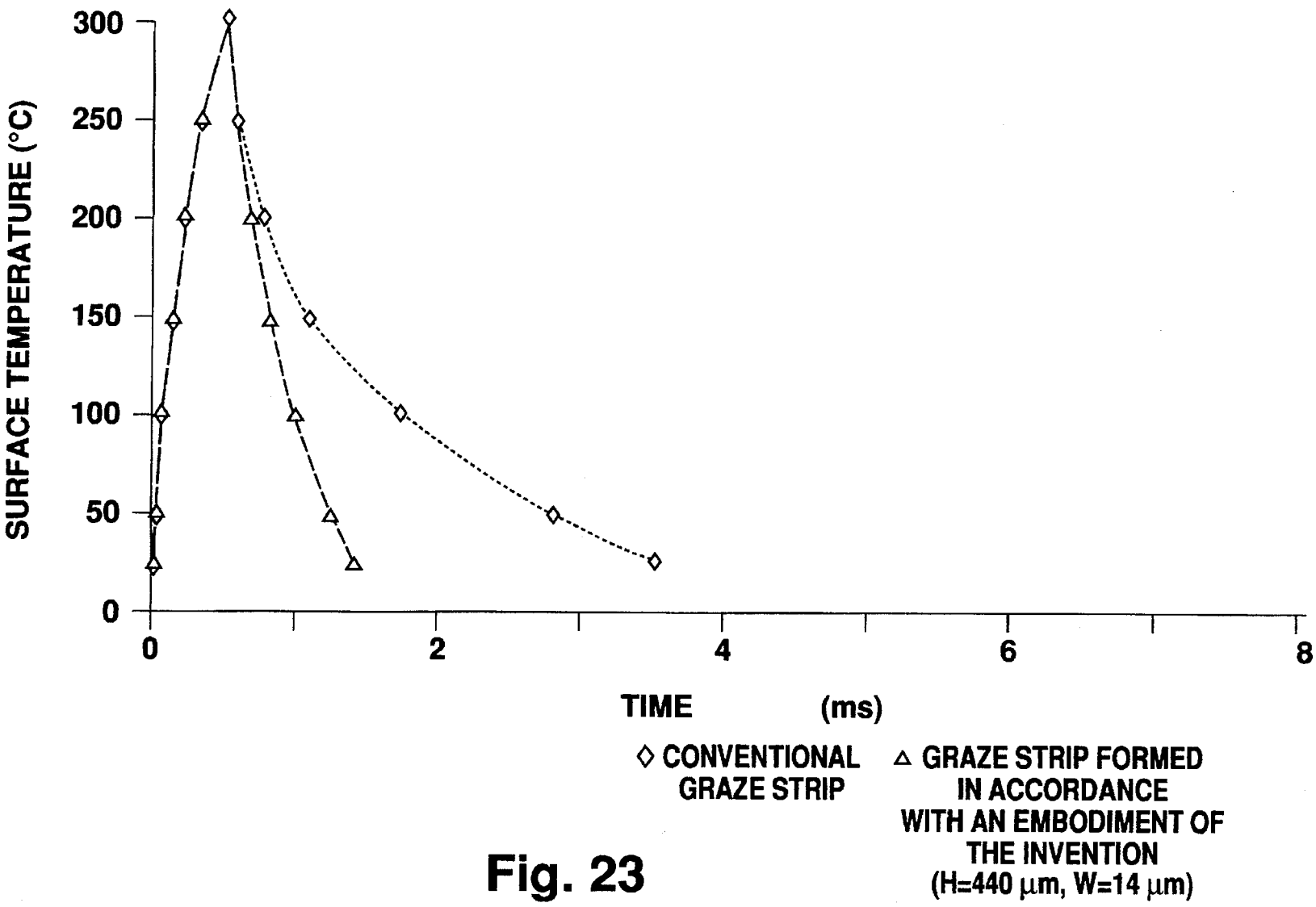
FIG. 23 is a chart showing the relationship between the surface temperature of the glaze layer and time, comparing the glaze strip of the invention which is the same size as FIG. 22 and is represented by triangle marks, with the conventional glaze strip which is the same as FIG. 22 and is represented by diamond marks.
Figure 24:
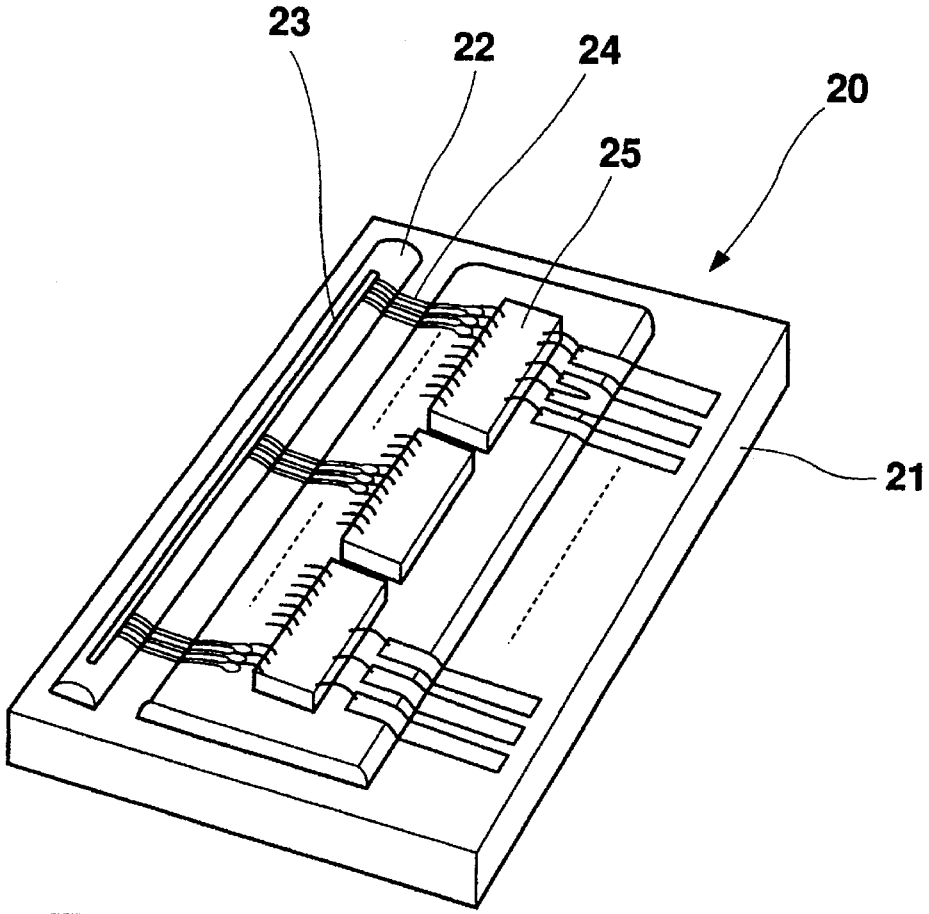
FIG. 24 illustrates a related art thermal head.
Figure 25:
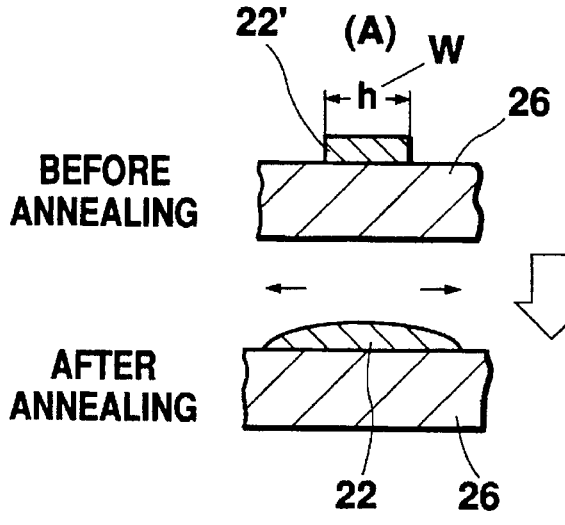
FIG. 25 cross-sectionally shows a glaze layer strip having a narrow width before and after annealing.
Figure 26:
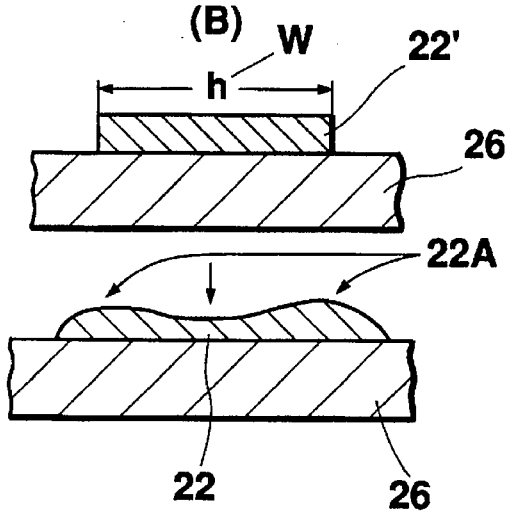
FIG. 26 cross-sectionally shows a glaze layer strip having a relatively broad width before and after annealing.
Figure 27:
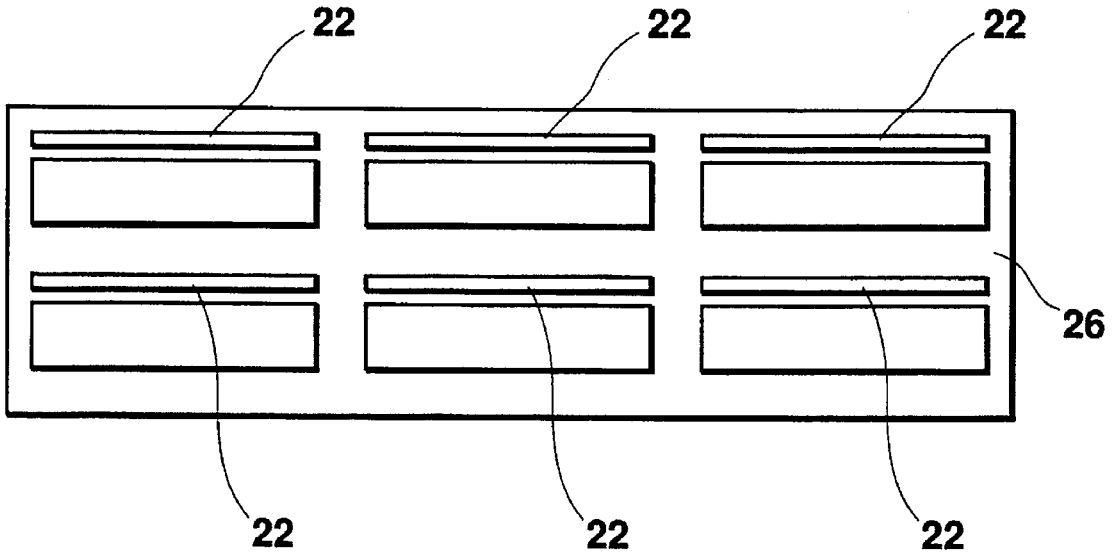
FIG. 27 illustrates a plurality of thermal heads formed on a large substrate.

FIGS. 22 and 23 show the superior heat elevation and releasing abilities of the glaze strip 3 formed by the present invention, by comparing surface temperature rise/fall properties between the glaze strips of the present invention and the related art. The diamond marks (◇) represent transition of the surface temperature of the glaze strip 3 of the present invention having a height "H" 440 μm and width "W" 14 μm, while the triangle marks (Δ) indicate transition of the surface temperature of the conventional glaze strip 20 having a height 1,040 μm and width 57 μm.

In FIG. 22, constant power pulses (time duration 0.3 ms) are applied to the heating element 5 with a predetermined time interval (0.82 ms) until the surface temperature of the heating element 5 reaches a predetermined value (300° C.), and temperature elevation is compared between the glaze strips of the present invention and the related art. The X (horizontal) axis represents the number of pulses applied, and Y (vertical) axis represents a peak surface temperature of the heating element 5 formed on the surface of the glaze strip.

In FIG. 23, the heat releasing ability is compared based on the time taken for the surface temperature of the heating element 5 to cool down from 300° C., where the X axis represents time and the Y axis represents a peak surface temperature of the heating element 5.

As is seen from the charts, the glaze strip formed in accordance with the present invention (H=440 μm, W=14

μm) is superior in quick temperature rise and fall with a narrow width and small heat capacity, compared with the conventional glaze strip.

Various changes and modifications can be made to the invention without departing from the scope of the invention, and an insulating layer strip for a thermal head having a desired shape and desired heat capacity can be provided.

What is claimed is:

1. A method for manufacturing a thermal head by forming and controlling a shape of an insulating layer strip formed on a substrate, the method comprising the steps of:

forming a thermoplastic insulating layer on a predetermined area of a substrate, removing an unnecessary portion of the insulating layer without removing a corresponding portion of the substrate so as to leave a predetermined portion forming an insulating layer strip having a substantially uniform width while leaving the substrate intact, heating the insulating layer strip at a temperature higher than the softening point thereof, and forming a heating element on the insulating layer strip.

2. A method according to claim 1, wherein a value of the height divided by the width of the insulating layer strip is 0.1 or more.

3. A method according to claim 1, wherein the removal of the unnecessary portion of the insulating layer is carried out by cutting.

4. A method according to claim 3, wherein said cutting operation is performed by rotation of a disc blade, and at least one side of the insulating layer strip is formed as a slope, using a disc blade having a tapered cutting surface.

5. A method according to claim 1, wherein the removal of the unnecessary portion of the insulating layer is carried out by covering a predetermined area, which is to be left as an insulating layer strip, with a protecting film, and removing the other area which is not covered with the protecting film.

6. A method according to claim 5, wherein said protecting film is a resist film made of a photosensitive polymer.

7. A method according to claim 5 or 6, wherein the removal of the unnecessary portion which is not covered with the protecting film is carried out by high speed bombardment from above of the insulating layer using abrasive particles.

8. A method according to claim 5 or 6, wherein the removal of the unnecessary portion which is not covered with the protecting film is carried out by chemical wet etching.

9. A method according to claim 5 or 6, wherein the removal of the unnecessary portion which is not covered with the protecting film is carried put by plasma etching.

10. A method for manufacturing a thermal head by forming and controlling a shape of an insulating layer strip formed on a substrate, the method comprising the steps of:

forming a rectangular thermoplastic insulating layer on a predetermined area of a substrate, forming a groove on the rectangular insulating layer along and parallel to one side thereof, at a predetermined distance from the side, without removing a corresponding portion of the substrate so as to divide the rectangular insulating layer into an insulating layer strip having a predetermined width and a remaining insulating layer region while leaving the substrate intact, heating the insulating layer strip and region at a temperature higher than the softening point thereof, forming a heating element on the insulating layer strip, and mounting driving circuit elements on the insulating layer region.

11. A method according to claim 10, further comprising the step of forming interconnect patterns on the surface of the groove for providing electrical connection between the heating element and the driving circuit, wherein said substrate is made of ceramic, said insulating layer is made of a material containing glass as a main component, and said groove is formed so as not to reach the surface of the substrate.

12. A method for manufacturing a thermal head that includes forming and controlling the shape of an insulating layer strip formed on a substrate, the method comprising the steps of:

forming a thermoplastic insulating layer over the entire surface of a rectangular substrate, forming a pair of grooves on the insulating layer without removing a corresponding portion of the substrate, the pair of grooves being spaced apart from each other by a predetermined distance to form, along the longitudinal direction of the substrate, an insulating layer strip of predetermined width therebetween, heating the insulating layer at a temperature higher than the softening point thereof, and forming a heat element on the insulating layer strip.

* * * * *